US005515731A

United States Patent [19]

Weisshaar et al.

[11] Patent Number: 5,515,731

[45] Date of Patent: May 14, 1996

[54] METHOD AND DEVICE FOR MONITORING CHATTER IN TWIN DRIVES OF ROLL STANDS

[75] Inventors: Bernhard Weisshaar, Herzogenaurach; Werner Schnalzger, Erlangen; Johann Wokusch, Forchheim, all of Germany

[73] Assignee: Siemens Aktiengesellschaft, Müchen, Germany

[21] Appl. No.: 272,491

[22] Filed: Jul. 8, 1994

[30] Foreign Application Priority Data

| | | | |
|---|---|---|---|
| Jul. 13, 1993 | [EP] | European Pat. Off. | 93111230 |
| Apr. 15, 1994 | [EP] | European Pat. Off. | 94105906 |

[51] Int. Cl.[6] ..... G01M 13/00

[52] U.S. Cl. ..... 73/659; 73/660; 72/241.4; 72/247

[58] Field of Search ..... 73/660, 659, 658, 73/593; 72/241.1, 247

[56] References Cited

U.S. PATENT DOCUMENTS

| | | | |
|---|---|---|---|
| 4,537,057 | 8/1985 | Kajiwara et al. | 72/243 |
| 4,843,854 | 7/1989 | Ackerly | 72/8 |
| 4,989,159 | 1/1991 | Liszka et al. | 364/508 |
| 5,058,434 | 10/1991 | Zaschel | 73/659 |
| 5,109,700 | 5/1992 | Hicho | 73/660 |

FOREIGN PATENT DOCUMENTS

| | | |
|---|---|---|
| 61-091566 | 5/1986 | Japan . |
| 62-009709 | 1/1987 | Japan . |
| 62-220207 | 9/1987 | Japan . |
| 82911 | 6/1982 | Luxembourg . |

OTHER PUBLICATIONS

Revue de Metallurgie, vol. 89, No. 6, Jun. 1992, Paris, France, pp. 571–577; Groothuizen et al.: Chatter detection in a five-stand cold mill.

*Primary Examiner*—Hezron E. Williams
*Assistant Examiner*—Rose M. Finley
*Attorney, Agent, or Firm*—Kenyon & Kenyon

[57] ABSTRACT

In chatter monitoring of twin drives of roll stands, vibrations of an upper drive and a lower drive are detected and monitored to determine whether a predetermined amplitude has been exceeded. If the amplitude has been exceeded, a chatter detection signal is generated. In order to prevent the chatter detection signal from being generated erroneously due to an operational pass vibrations, the frequencies of the vibrations of the upper drive and the lower drive are monitored for identity; when the frequencies are identical, the chatter detection signal is suppressed.

19 Claims, 4 Drawing Sheets

METHOD AND DEVICE FOR MONITORING CHATTER IN TWIN DRIVES OF ROLL STANDS

BACKGROUND OF THE INVENTION

The present invention relates generally to methods and devices for monitoring chatter in twin drives for roll stands, and more particularly to a method and device for monitoring chatter in twin drives of roll stands in which the two rolls are driven by separate motors.

In a twin drive for a roll stand, the upper roll and the lower roll of the roll stand are driven separately by an upper motor and a lower motor, respectively. The coupling of each motor through a more or less torsion-proof shaft to the corresponding roll produces a structure capable of rotational oscillation. Pronounced changes in the frictional values in the roll nip can trigger a self-excitation process, in which the rotational energy supplied to the rolls is converted into torsional oscillating energy. The mechanical rotational oscillation behavior of the twin drive is thus undamped in such a way that the rotational speed regulation for the motors can no longer provide sufficient stabilization. If the adhesion between the two rolls is lost, slipping processes occur and as a consequence thereof, so-called chatter occurs.

It is known that chatter can be detected by measuring the oscillations of the drives and determining if a predetermined amplitude is exceeded by these oscillations. In the event an amplitude of the oscillations is exceeded, a chatter detection signal is generated that is delivered to the rotational speed regulator to reduce the rotational speed until the chatter stops. Operational vibrations triggered by a pass in the roll stand must not, however, result in a response of the chatter monitoring system. In the past, well-damped pass vibrations could only be selected through the level of the amplitude threshold of building chatter vibrations. Often, however, the time remaining for a reaction is too short, so that damage to the drive can occur.

Hence, the present invention is directed to the problem of developing a method for permitting faster and more reliable differentiation of operational pass vibrations and chatter vibrations. In addition, the present invention is directed to the problem of developing a device for implementing the method of the present invention.

SUMMARY OF THE INVENTION

The present invention solves the problem of developing a method for chatter monitoring in twin drives of roll stands in which vibrations of the upper drive and vibrations of the lower drive are detected, by providing that: (1) the detected vibrations are monitored to determine whether they exceed a given amplitude, and in the event they exceed this amplitude, a chatter detection signal is generated; and (3) the frequencies of the oscillations of the upper drive and the lower drive are also monitored for identity, and in the event their frequencies are identical, the chatter detection signal is suppressed.

The present invention solves the problem of developing a device for implementing the above method for chatter monitoring in twin drives of roll stands by providing: (1) a device for detecting vibrations of the upper drive and a device for detecting vibrations of the lower drive; (2) a device for monitoring the detected vibrations to determine whether they exceed a predetermined amplitude and to generate a chatter detection signal if the amplitude is exceeded, and (3) a device for monitoring the frequencies of the vibrations detected for identity, and for suppressing the chatter detection signal if the frequencies are identical.

Advantageously, the present invention takes advantage of the phenomenon that operational pass vibrations and chatter vibrations differ in their natural frequencies. In a normal pass, the upper and lower rolls adhere to one another, so that the two rolls vibrate with a common natural frequency due to mechanical coupling. When on the other hand slipping processes occur and adhesion is lost, the upper and lower rolls and the corresponding drives vibrate at their own natural frequencies, with the natural frequencies of the upper drive and lower drive being different because the drive shafts differ in length as a rule.

Amplitude and frequency monitoring of the detected vibrations is advantageously performed by vibration-influenced measured parameters, such as the driving rpm or the drive torque of the upper drive. Vibration-influenced measured parameters of the lower drive are each supplied to a system of bandpass filters with center frequencies staggered in the natural frequency range of the drives. The output signals of the bandpass filters are monitored to determine whether the predetermined amplitude is exceeded. To monitor the vibrations of the upper drive and of the lower drive for identity of frequency, the output signals of all bandpass filter pairs with bandpass filters for the upper drive and the lower drive and corresponding center frequency are compared with one another. Division of the natural frequency ranges of the two drives by means of the bandpass filters into a grid of frequency intervals, without high circuit-design or computer expense, permits a very rapid frequency comparison of the vibrations of the two drives. Preferably the output signals of each bandpass filter pair are monitored to determine whether they jointly exceed a limiting value. Alternatively, the output signals of each bandpass filter pair can be subtracted from one another, with the differential signal thus obtained being monitored to determine whether a limiting value has been exceeded.

To determine the identity of the frequencies of the vibrations of the upper drive and the lower drive, an evaluation is performed, advantageously by an AND linking of all cases of exceeding the limiting value detected for the bandpass filter pairs. Alternatively, the evaluation of the whether the limiting values are exceeded can also be performed as follows: with a given number of bandpass filter pairs having center frequencies with a predetermined relationship to one another, for example having center frequencies immediately adjacent to one another, an occurrence of the limiting value being exceeded must be detected in order to be able to determine from this that the frequencies of the vibrations being observed are equal.

In order to increase the detection rate when vibrations develop, provision is made such that the output signal of each bandpass filter is rectified and at the same time is differentiated, rectified, multiplied by the reciprocal of the center frequency of the bandpass filter, and then added to the rectified output signal.

Amplitude monitoring of the detected vibrations takes place in the simplest fashion by virtue of the fact that the output signal with the greatest amplitude is selected from the output signals of the bandpass filter and used for monitoring to determine whether the predetermined amplitude has been exceeded.

In order to reduce or eliminate chatter vibrations, when the chatter detection signal appears, the roll speed is reduced until the slipping processes cease and the lost adhesion between the upper and lower rolls is restored. In this connection, it is advantageously provided that the detected vibrations of the upper drive and lower drive are monitored to determine whether different amplitudes have been exceeded, that when the respectively lower amplitude is exceeded, a rampwise reduction of the roll speed takes place and when the respectively higher amplitude is exceeded, an abrupt reduction of the roll speed takes place.

DETAILED DESCRIPTION

Figure 1:
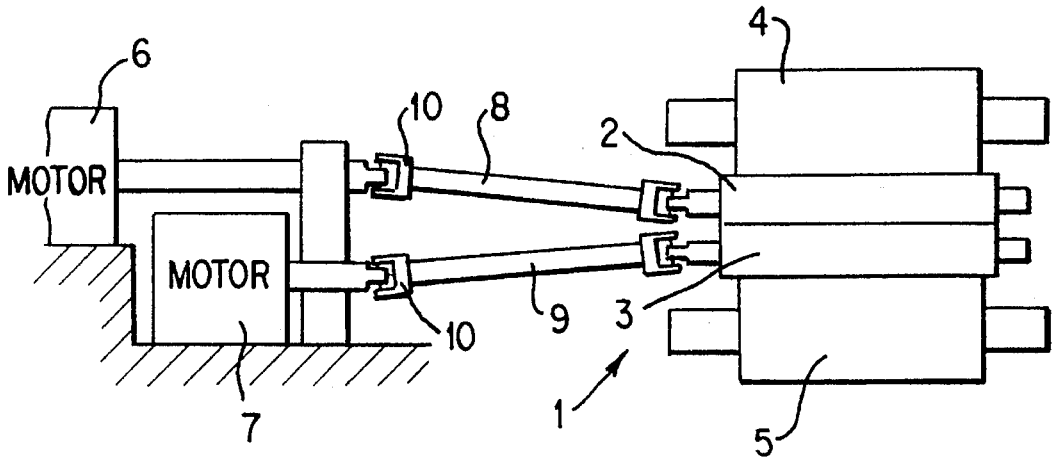
FIG. 1 shows an example of a twin drive on a roll stand.

FIG. 1 shows a roll stand 1 with two operating rolls, namely an upper roll 2 and a lower roll 3, and matching support rolls 4 and 5. Upper roll 2 and lower roll 3 are driven through a twin drive, in which two separate motors 6 and 7 are connected by drive shafts 8 and 9 and universal joints 10 with upper roll 2 and lower roll 3, respectively. Since universal joints 10 can compensate for only a limited angle, the axial spacing for the two motors 6 and 7 must be kept small to limit the lengths of drive shafts 8 and 9. The size of motors 6 and 7 therefore requires a staggered arrangement of the two motors 6 and 7.

Figure 2:
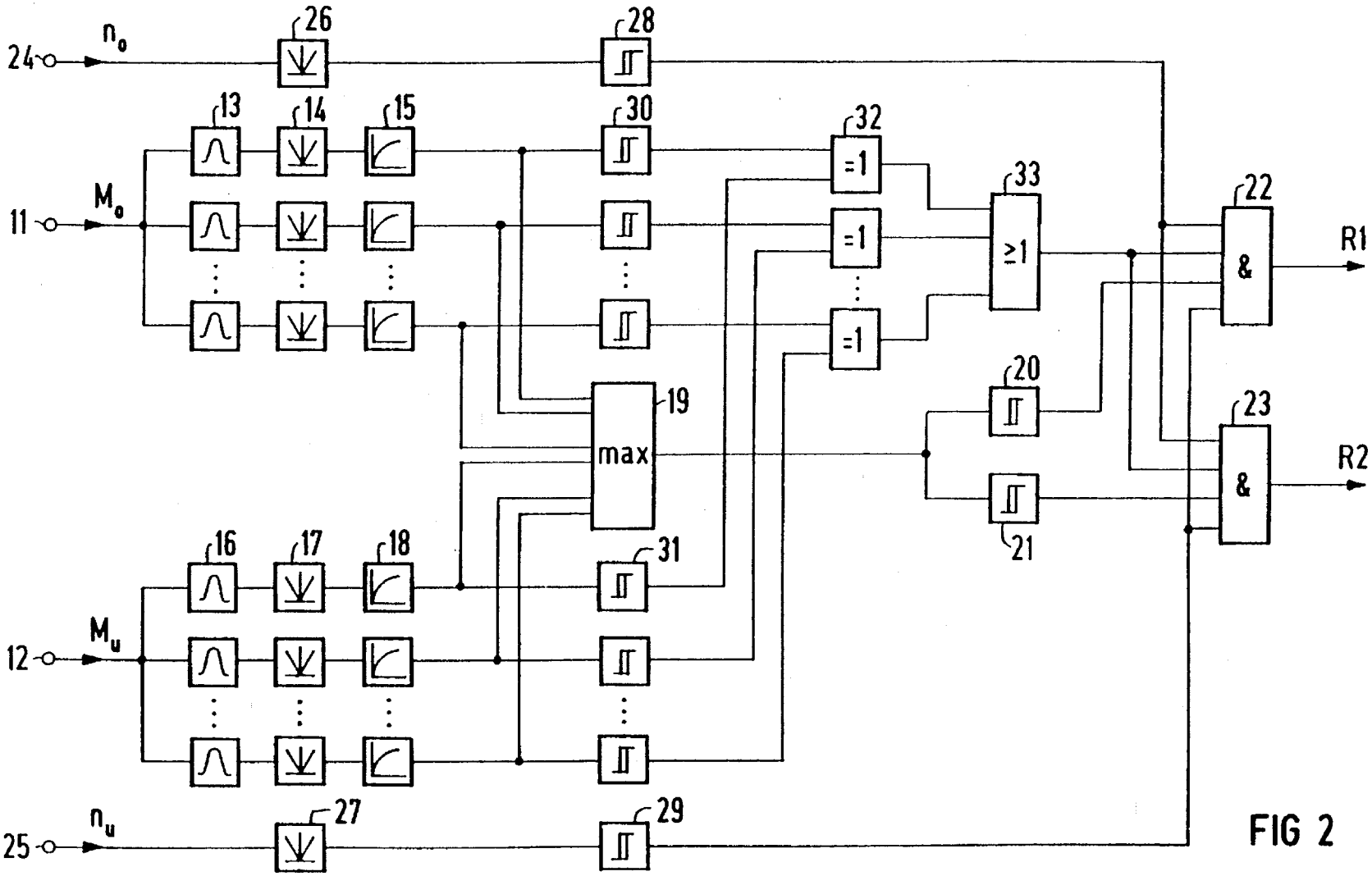
FIG. 2 depicts an embodiment of the method of the present invention in the form of a block diagram for generating two chatter detection signals for chatter vibrations of different magnitudes.

The circuit shown in FIG. 2 for detecting chatter vibrations receives at a point 11 a measured value $M_o$, which is influenced by vibrations of the upper drive. The circuit of FIG. 2 also receives at a point 12, a vibration-related measured value $M_u$ for the lower drive. Measured drive parameters $M_o$ and $M_u$ can be, for example, the rotational speed, the torque, or the drive current in motors 6 and 7. Measured value $M_o$ of the upper drive is supplied to a plurality of bandpass filters 13 with different center frequencies staggered between the minimum and maximum natural frequencies of the twin drive. Each of bandpass filters 13 is followed by an element 14 to form the value of the bandpass filter signals and an element 15 to smooth the signal. The measured value $M_u$ of the lower drive is likewise fed to a plurality of bandpass filters 16, whose center frequencies are staggered in the same way as in band filters 13. Band filters 16 are likewise each followed by an element 17 for generating the value of the bandpass filter signals and an element 18 for smoothing the signal. The smoothed values of the bandpass filter signals at the outputs of elements 15 and 18 are fed to a maximum value detector 19 that selects the maximum from the input signals supplied to them and passes it on. Maximum value detector 19 is followed by two threshold value detectors 20 and 21, each of which generates an output signal when the maximum value supplied to it exceeds a predetermined threshold value. Threshold value detector 20 is set to one threshold value (low threshold value) and threshold value detector 21 is set to a higher threshold value. The output signal from threshold detector 20 is fed to an AND element 22 and that from threshold value detector 21 is fed to another AND element 23.

Therefore, when vibrations develop within the twin drive, the vibration maximum contained in the frequency spectrum of the vibrations is monitored to determine whether two different amplitudes have been exceeded. When the lower amplitude is exceeded, a chatter detection signal R1 is generated at the output of AND element 22, and when the higher amplitude is exceeded an additional chatter detection signal R2 is generated at the output of AND element 23 if the additional condition is met that the current rotational speeds of the twin drive are exceeding a given value and the vibrations detected are not operational pass vibrations.

Then rotational speeds $n_o$ and $n_u$ of the upper drive and lower drive are fed to the circuit at points 24 and 25. Rotational speeds $n_o$ and $n_u$, after amount formation in amount-forming elements 26 and 27 independently of the rotation direction in limiting value detectors 28 and 29 are monitored for exceeding a limiting value, for example 5% of the maximum rotational speed. Each of the two limiting value detectors 28 and 29 is connected at its output with the two AND elements 22 and 23.

To differentiate between chatter vibrations and operational pass vibrations, each of the individual elements 15 and 18 for smoothing the signal is followed by a limiting value detector 30 or 31 that generates an output signal when the smoothed quantity of the bandpass filter signal exceeds a limiting value, for example 5% of the amount of measured values $M_o$ and $M_u$. The outputs of each two limiting value detectors 30 and 31, one of which is associated with a bandpass filter 13 for the upper drive and the other is associated with a bandpass filter 16 with the same center frequency for the lower drive, are each followed by an antivalence element (exclusive OR) 32, which generates an output signal when only one of the two limiting value detectors 30 or 31 reports that a limiting value has been exceeded. The outputs of antivalence elements 32 are supplied to an OR element 33 connected on the output side to each of the two AND elements 22 and 23. When the vibrations for one drive, i.e. the upper drive, exceed the limiting value in any of the staggered frequency intervals defined by bandpass filter pairs 13 and 16, while in the same frequency interval no limiting-value-exceeding vibrations are detected for the other drive, i.e. the lower drive, this indicates that there is no adhesion between upper roll 2 and lower roll 3, so that the upper and lower drives are vibrating independently of one another at different natural frequencies. In this case, generation of chatter detection signals R1 and R2 is authorized. When however, in all frequency intervals, both the vibrations of the upper drive and the vibrations of the lower drive are detected as being in excess of the limiting value, this indicates that the upper and lower drives are jointly vibrating at the same natural frequency. In this case, therefore, operational pass vibrations are taking place and so generation of chatter detection signals R1 and R2 is suppressed.

Figure 3:
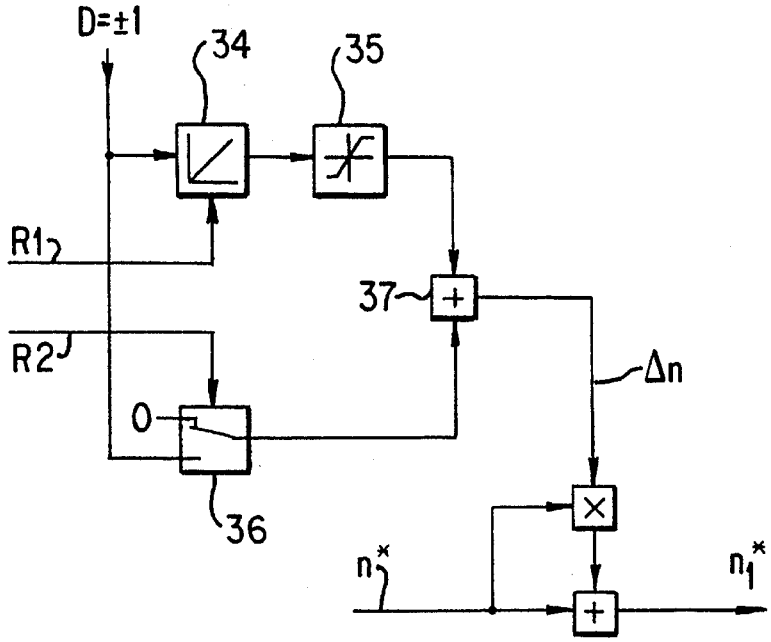
FIG. 3 is an embodiment of the device of the present invention for the implementation of roll speed reduction as a function of chatter detection signals.

As FIG. 3 shows, chatter detection signal R1 which is generated when the chatter vibrations exceed the lower threshold value of threshold value detector 20 is used to turn an integrator 34 on and off. Integrator 34 receives on the input side a rotation direction signal D, which has a value of +1 or −1 depending on the rolling direction or rotation direction of the twin drive. From this rotation direction signal D, integrator 34 generates a rampwise output signal with a rising or falling slope, with the value of the output signal being limited in a subsequent stage 35. If the detected chatter vibration exceeds the higher threshold value of threshold value detector 21, an abrupt output signal is generated with the aid of a controllable switch 36 whose value, depending on the rolling direction, jumps from 0 to 1 or from 0 to −1. The output values of integrator 34 and controllable switch 36 are added in a summing element 37 to form a rotational speed correction value Δn, with which the rotational speed set value n* for the twin drive can be convened into a corrected rotational speed set value $n_1$*=n* (1+/Δn).

When chatter vibrations occur, therefore, the rotational speed for the twin drive is reduced either rampwise or abruptly, depending on whether the detected chatter vibrations exceed the lower or the higher threshold value.

Figure 4:
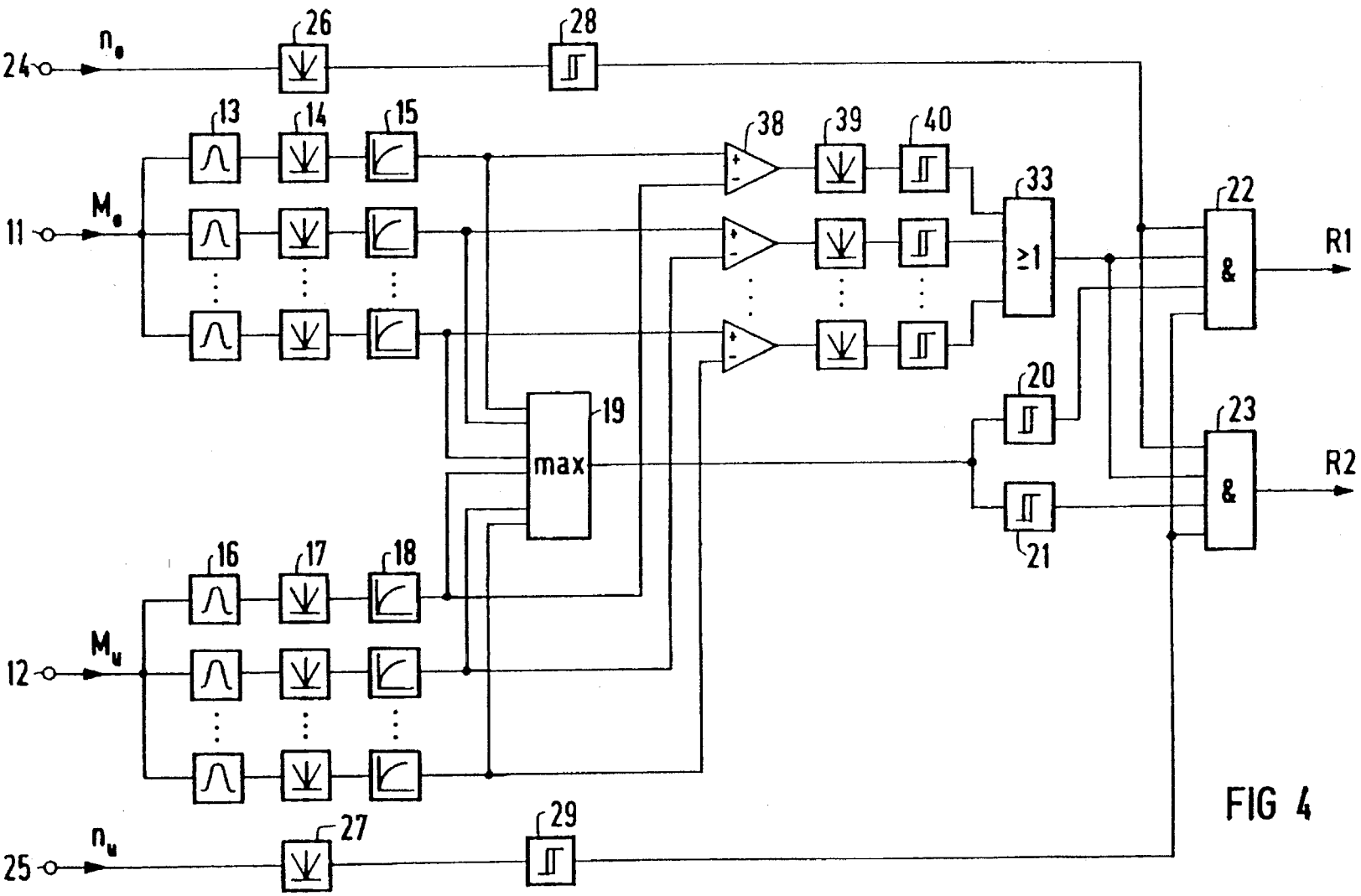
FIG. 4 is an embodiment of the present invention that is an alternative to the embodiment shown in FIG. 2.

FIG. 4 shows a variation on the circuit that differs from the circuit shown in FIG. 2 only in that instead of limiting value detectors 30, 31 and antivalence elements 32, subtraction elements 38 are provided, with following amount-forming elements 39 and limiting value detectors 40. The rectified and smoothed output signals from bandpass filters 13 and 16 with matching center frequencies, associated with the upper and lower drives, are subtracted from one another, with the difference signal thus obtained being monitored after being rectified to determine whether they exceed a limiting value.

Figure 5:
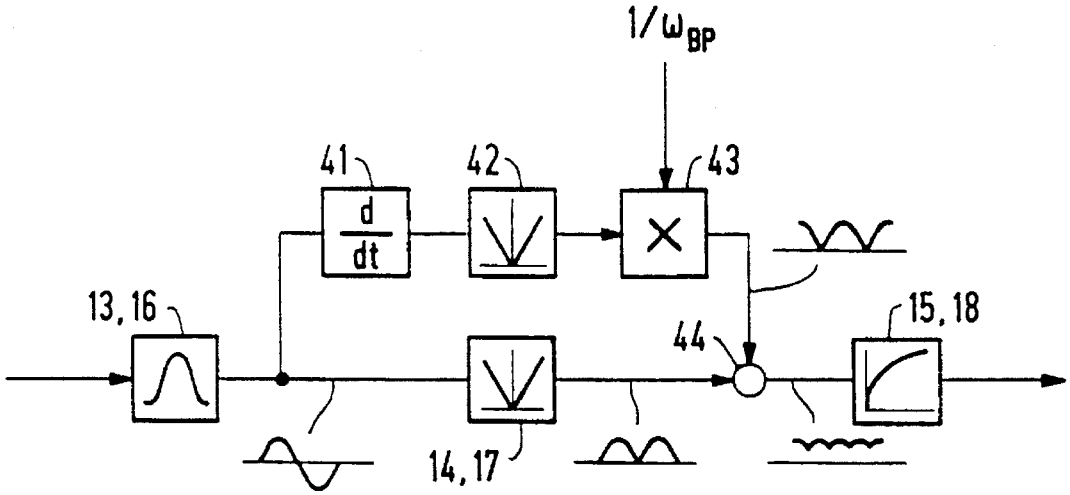
FIG. 5 is an embodiment of the present invention for increasing the response rate when vibrations occur.

FIG. 5 shows an example of increasing the response rate of the circuits shown in FIGS. 2 and 4 relative to the development of vibrations. For this purpose the output signal from each bandpass filter 13 or 16 is additionally differentiated in a differentiating element 41, rectified in an amount-forming element 42, and multiplied in a multiplying element 43 with the reciprocal of the respective center frequency $\omega_{BP}$ of bandpass filter 13 or 16 before it is added in a summing element 44 to the rectified output signal of bandpass filter 13 or 16. As a result, the ripple of the signal at the input to signal smoothing element 15 or 18 is reduced, so that the smoothing effect and hence the signal delay of signal smoothing element 15 or 18 can be reduced.

What is claimed is:

1. A method for chatter monitoring in a twin drive of a roll stand, comprising the steps of:

a) detecting a vibration of an upper drive and a vibration of a lower drive;

b) determining whether the vibrations detected in step a) exceed a predetermined amplitude; and c) generating a chatter detection signal if the vibrations detected in step a) exceed the predetermined amplitude; and d) determining a frequency of the vibration of the upper drive and a frequency of the vibration of the lower drive; and e) suppressing the chatter detection signal generated in step c) if the frequencies determined in step d) are identical.

2. The method according to claim 1, further comprising the steps of:

f) passing a vibration-influenced measured values ($M_o$) of the upper drive and a vibration-influenced measured values ($M_u$) of the lower drive to a system of bandpass filter pairs having center frequencies staggered in a natural frequency range of the upper and lower drives;

g) determining whether output signals from the system of bandpass filters exceed the predetermined amplitude; and h) comparing output signals from each of the bandpass filters for the upper drive with corresponding bandpass filters for the lower drive.

3. The method according to claim 2, further comprising the step of: i) determining whether both output signals from each bandpass filter pair exceed a limiting value.

4. The method according to claim 2, further comprising the steps of:

i) subtracting output signals of each bandpass filter pair from one another to generate a difference signal for each bandpass filter pair; and j) determining whether the difference signals generated in step i) exceed a limiting value.

5. The method according to claim 3, further comprising the step of:

j) determining whether all the limiting values for all the bandpass filters are simultaneously exceeded in step i).

6. The method according to claim 4, further comprising the step of:

k) determining whether all the limiting values for all the difference signals are simultaneously exceeded in step j).

7. The method according to claim 3, further comprising the step of:

j) determining whether all limiting values for all the bandpass filters are simultaneously exceeded in step i) by performing an AND operation of outputs of a threshold detector for each bandpass filter.

8. The method according to claim 4, further comprising the step of:

k) determining whether all limiting values for all difference signals are simultaneously exceeded in step i) by performing an AND operation of outputs of a threshold detector for each difference signal.

9. The method according to claim 2, further comprising the steps of:

i) selecting an output signal with the greatest amplitude from the output signals of the bandpass filters to determine whether the predetermined amplitude has been exceeded.

10. The method according to claim 3, further comprising the steps of:

j) selecting an output signal with the greatest amplitude from the output signals of the bandpass filters to determine whether the predetermined amplitude has been exceeded.

11. The method according to claim 2, further comprising the step of:

i) rectifying the output signal from each bandpass filter;

j) differentiating the output signal from each of the bandpass filters;

k) multiplying each of the output signals differentiated in step j) by the reciprocal of the center frequency ($\omega_{BP}$) of the bandpass filter corresponding to the output signal; and l) adding each of the results in step k) to the rectified output signal corresponding to each of the bandpass filters obtained in step i).

12. The method according claim 1, further comprising the step of:

f) reducing a rolling speed when a chatter detection signal appears.

13. The method according to claim 2, further comprising the steps of:

i) determining whether the vibrations detected in step a) exceed a lower amplitude;

j) determining whether the vibrations detected in step a) exceed a higher amplitude;

k) rampwise reducing rolling speed when the lower amplitude is exceeded; and l) abruptly reducing the rolling speed when the higher amplitude is exceeded.

14. A device for chatter monitoring in twin drives of roll stands, comprising:

a) a first detector detecting a vibration in an upper drive;

b) a second detector detecting a vibration in a lower drive;

c) an amplitude monitor being coupled to the first and second detectors, monitoring the vibrations detected to determine whether a predetermined amplitude has been exceeded, and generating a chatter detection signal when the predetermined amplitude is exceeded; and d) a device being coupled to the first and second detectors, and monitoring frequency of each vibration detected, and suppressing the chatter detection signal when the frequencies are identical.

15. The device according to claim 14, wherein the first and second detectors each further comprises a system of bandpass filters with staggered center frequencies.

16. An apparatus for monitoring chatter in a roll stand having an upper drive and a lower drive, said apparatus comprising:

a) a first plurality of bandpass filters with different center frequencies staggered between a minimum natural frequency of the upper drive and a maximum natural frequency of the upper drive, said first plurality of bandpass filters receiving a first measured value that is influenced by a vibration in the upper drive, each of said first plurality of bandpass filters outputting a first filtered signal;

b) a second plurality of bandpass filters with different center frequencies staggered between a minimum natural frequency of the lower drive and a maximum natural frequency of the lower drive, each of said second plurality of bandpass filters corresponding to one of said first plurality of bandpass filters, said second plurality of bandpass filters receiving a second measured value that is influenced by a vibration in the lower drive, each of said second plurality of bandpass filters outputting a second filtered signal;

c) a first plurality of value forming elements, one for each of the first plurality of bandpass filters, each receiving one of the first filtered signals and each outputting a first value representing a level of the first measured value at a center frequency of the associated bandpass filter;

d) a second plurality of value forming elements, one for each of the second plurality of bandpass filters, each receiving one of the second filtered signals and each outputting a second value representing a level of the second measured value at a center frequency of the associated bandpass filter;

e) a first plurality of smoothing elements, one for each of the first plurality of value forming elements, each receiving one of the first values, and each outputting a first smoothed value;

f) a second plurality of smoothing elements, one for each of the second plurality of value forming elements, each receiving one of the second values, and each outputting a second smoothed value;

g) a maximum value detector being coupled to the first and second plurality of smoothing elements, and outputting a maximum value of the first and second smoothed values;

h) a first plurality of limiting value detectors, one for each of the first plurality of smoothing elements, each receiving one of the first smoothed values, and each outputting a first signal if predetermined threshold was exceeded;

i) a second plurality of limiting value detectors, one for each of the second plurality of smoothing elements, each receiving one of the second smoothed values, and each outputting a second signal if predetermined threshold was exceeded;

j) a plurality of antivalence elements, having a first input being coupled to one the first plurality of limiting value detectors, having a second input being coupled to one of the second plurality of limiting value detectors, and each outputting a signal when only one of the first or second inputs indicates that a limiting value was exceeded;

k) an OR gate having an input coupled to each of the plurality of antivalence elements, and outputting a signal when at least one of the OR gate's inputs is at a logical one level;

l) a low threshold detector being coupled to the maximum value detector and outputting a signal when a predetermined first threshold value is exceeded;

m) a high threshold detector being coupled to the maximum value detector and outputting a signal when a predetermined second threshold value is exceeded, wherein the second threshold value is higher than the first threshold value;

n) a first roll value forming element receiving a rotational speed signal of the upper drive and outputting a rotational speed value for the upper drive;

o) a second roll value forming element receiving a rotational speed signal of the lower drive and outputting a rotational speed value for the lower drive;

p) a first speed threshold detector receiving the rotational speed for the upper drive and outputting a signal if the rotational speed value of the upper drive exceeds a predetermined maximum speed;

q) a second speed threshold detector receiving the rotational speed for the lower drive and outputting a signal if the rotational speed value of the lower drive exceeds a predetermined maximum speed;

r) a first AND gate being coupled to the first and second speed threshold detectors, being coupled to the OR gate, being coupled to the low threshold detector and outputting a first chatter detection signal; and s) a second AND gate being coupled to the first and second speed threshold detectors, being coupled to the OR gate, being coupled to the high threshold detector and outputting a second chatter detection signal.

17. The apparatus according to claim 16, further comprising a speed regulator for the upper and lower drives rampwise reducing the rolling speed when the first chatter detection signal is generated, and abruptly reducing the rolling speed when the higher amplitude is exceeded.

18. An apparatus for monitoring chatter in a roll stand having an upper drive and a lower drive, said apparatus comprising:

a) a first plurality of bandpass filters with different center frequencies staggered between a minimum natural frequency of the upper drive and a maximum natural frequency of the upper drive, said first plurality of bandpass filters receiving a first measured value that is influenced by a vibration in the upper drive, each of said first plurality of bandpass filters outputting a first filtered signal;

b) a second plurality of bandpass filters with different center frequencies staggered between a minimum natural frequency of the lower drive and a maximum natural frequency of the lower drive, each of said second plurality of bandpass filters corresponding to one of said first plurality of bandpass filters, said second plurality of bandpass filters receiving a second measured value that is influenced by a vibration in the lower drive, each of said second plurality of bandpass filters outputting a second filtered signal;

c) a first plurality of value forming elements, one for each of the first plurality of bandpass filters, each receiving one of the first filtered signals and each outputting a first value representing a level of the first measured value at a center frequency of the associated bandpass filter;

d) a second plurality of value forming elements, one for each of the second plurality of bandpass filters, each receiving one of the second filtered signals and each outputting a second value representing a level of the second measured value at a center frequency of the associated bandpass filter;

e) a first plurality of smoothing elements, one for each of the first plurality of value forming elements, each receiving one of the first values, and each outputting a first smoothed value;

f) a second plurality of smoothing elements, one for each of the second plurality of value forming elements, each receiving one of the second values, and each outputting a second smoothed value;

g) a maximum value detector being coupled to the first and second plurality of smoothing elements, and outputting a maximum value of the first and second smoothed values;

h) a plurality of differential amplifiers, each having a first input being coupled to one of the first plurality of smoothing elements, each having a second input being coupled to one of the second plurality of smoothing elements, and each outputting a difference signal;

i) a third plurality of value forming elements, one for each of the plurality of differential amplifiers, each receiving one of the difference signals and each outputting a difference value;

j) a plurality of threshold detectors, one for each of the third plurality of value forming elements, each receiving one of the difference values and each outputting a signal if the one difference value exceeds a predetermined limit;

k) an OR gate having an input coupled to each of the plurality of threshold detectors, and outputting a signal when at least one of the OR gate's inputs is at a logical one level;

l) a low threshold detector being coupled to the maximum value detector and outputting a signal when a predetermined first threshold value is exceeded;

m) a high threshold detector being coupled to the maximum value detector and outputting a signal when a predetermined second threshold value is exceeded, wherein the second threshold value is higher than the first threshold value;

n) a first roll value forming element receiving a rotational speed signal of the upper drive and outputting a rotational speed value for the upper drive;

o) a second roll value forming element receiving a rotational speed signal of the lower drive and outputting a rotational speed value for the lower drive;

p) a first speed threshold detector receiving the rotational speed for the upper drive and outputting a signal if the rotational speed value of the upper drive exceeds a predetermined maximum speed;

q) a second speed threshold detector receiving the rotational speed for the lower drive and outputting a signal if the rotational speed value of the lower drive exceeds a predetermined maximum speed;

r) a first AND gate being coupled to the first and second speed threshold detectors, being coupled to the OR gate, being coupled to the low threshold detector and outputting a first chatter detection signal; and s) a second AND gate being coupled to the first and second speed threshold detectors, being coupled to the OR gate, being coupled to the high threshold detector and outputting a second chatter detection signal.

19. The apparatus according to claim 18, further comprising a speed regulator for the upper and lower drives receiving the first and second chatter signals and rampwise reducing the rolling speed when the first chatter detection signal is generated, and abruptly reducing the rolling speed when the higher amplitude is exceeded.

* * * * *